United States Patent [19]

Whittle

[11] Patent Number: 4,685,828

[45] Date of Patent: Aug. 11, 1987

[54] IRRIGATION CHANNEL GATE

[76] Inventor: Lee M. Whittle, P.O. Box 7, Brawley, Calif. 92227

[21] Appl. No.: 883,978

[22] Filed: Jul. 10, 1986

[51] Int. Cl.[4] ..... E02B 7/20

[52] U.S. Cl. ..... 405/87; 251/147; 405/40

[58] Field of Search ..... 405/39, 40, 41, 87, 405/90, 99, 100; 251/89, 147, 231, 279

[56] References Cited

U.S. PATENT DOCUMENTS

| | | | |
|---|---|---|---|
| 544,069 | 8/1895 | Pearson | 405/40 X |
| 973,022 | 10/1910 | Fitzpatrick . | |
| 1,049,091 | 12/1912 | Hogsett . | |
| 1,333,217 | 3/1920 | Perry . | |
| 1,480,141 | 1/1924 | Artese . | |
| 1,522,772 | 1/1925 | Fearnow et al. | 405/87 X |
| 1,528,528 | 3/1925 | Cheyney . | |
| 2,628,056 | 2/1953 | Fuller | 405/40 X |
| 2,813,694 | 11/1957 | Harmes et al. | 405/100 X |
| 2,854,823 | 10/1958 | Fisher | 61/28 |
| 3,400,909 | 9/1968 | Shettel | 251/147 |
| 3,521,665 | 7/1970 | Poulsen | 137/383 |

*Primary Examiner*—David H. Corbin

*Attorney, Agent, or Firm*—Brown, Martin, Haller & Meador

[57] ABSTRACT

An irrigation ditch gate, comprising port means for defining a passage for conduction of water, configured for mounting in a wall of an irrigation ditch and attached to a frame. A plate means comprising a generally circular plate is pivotally mounted on the port means, for being pivoted transverse to the passage, between a closed position to cover the passage and prevent the flow of water therethrough, and an open position to substantially uncover the passage to permit the flow of water therethrough. A handle lever moves the gate between the closed and open positions being pivotally attached on a first end to the plate. A moving fulcrum is provided for the handle by a second lever having one end pivotally attached to the frame and a second end pivotally attached to the handle. A retention means exerts a retaining force on the handle so that the plate is urged into close wiping engagement with the port means. The port means can be provided with a plurality of means for securing to the sidewall of an irrigation ditch.

17 Claims, 10 Drawing Figures

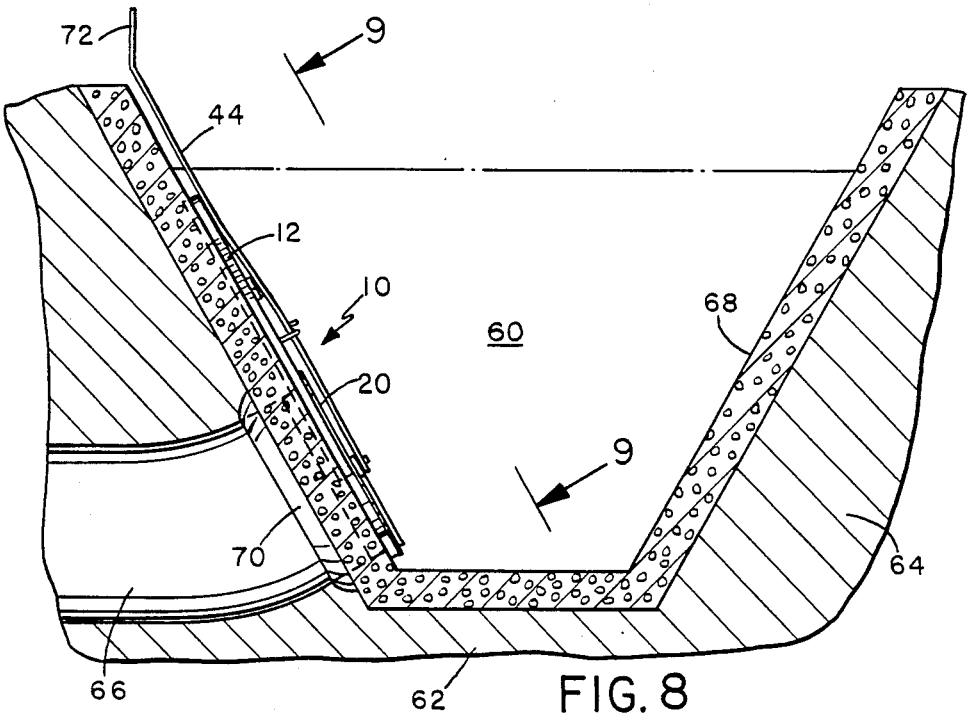
FIG. 8
FIG. 9
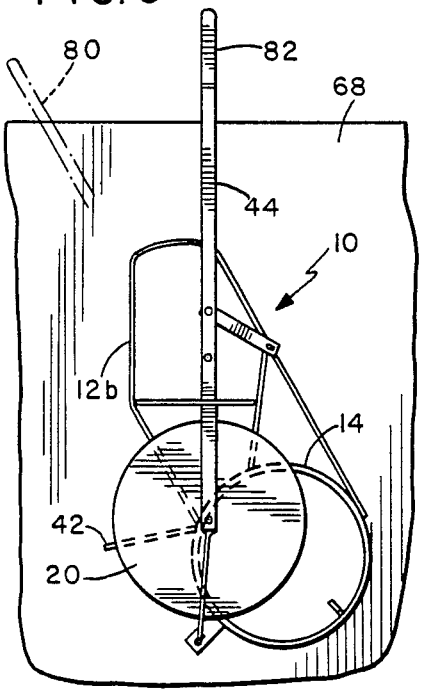
FIG. 10
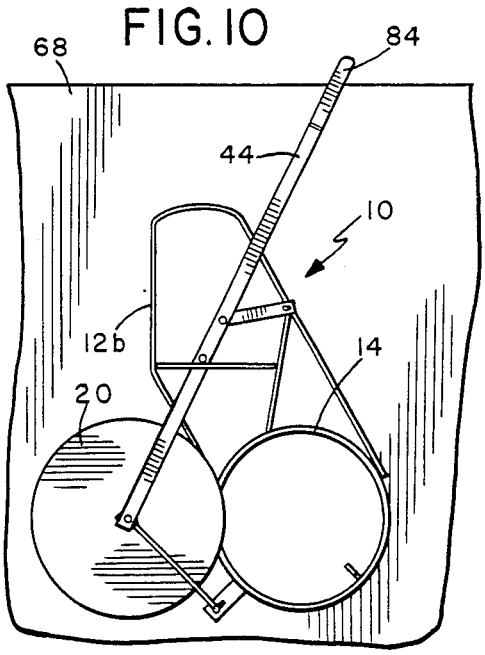

IRRIGATION CHANNEL GATE

BACKGROUND OF THE INVENTION

1. FIELD OF THE INVENTION

This invention relates to irrigation systems and more particularly to an irrigation ditch gate utilizing a lever actuated plate to pivot transversely across a passage in a water port and open and close the port. The invention further relates to an irrigation ditch gate which can be mounted in the sidewalls of an irrigation ditch and uses substantially uniform actuation force to activate a valve gate.

2. BACKGROUND

Several geographical regions such as the southwestern United States are suitable for crop production only with substantial amounts of irrigation. Therefore, many approaches to irrigating large sections of land have been used in such regions, including: canals, ditches, sloughs, dams and a variety of sprinkler systems. Sprinkler systems require pressurized water sources or pumping stations which are often unavailable or expensive, and use large numbers of mechanical parts which can fail. Therefore, one of the most widely used irrigation techniques is that of a distributed irrigation ditch system using gravity flow to transport water over large land areas.

Typical irrigation ditch systems employ one or more central ditches to transport the water across land and a series of drain or access pipes to further distribute the water into furrows or onto crop-bearing fields. As a part of this water distribution it is obviously necessary to control and monitor the flow of water out of irrigation ditches into irrigation pipes and smaller ditches to successfully produce crops by watering specific areas at specific times. Incorrect amounts of water, either too much or too little, can destroy growing crops, and water is too expensive to erroneously transfer to fallow areas. Therefore, several irrigation ditch gates have been designed in order to provide some control over the flow of water out of irrigation ditches.

Two widely used types of irrigation gates utilize square plates, that slide on two guide rails attached to the sides of an irrigation ditch to cover and uncover a port or opening for an exit pipe connected to the ditch. These gates rely on gravity to assist in lowering the gate into place. In one gate, a threaded rod actuator extends up over the side of the irrigation ditch where it attaches to a handle. The gate is raised or lowered by turning the handle which either rotates the rod through a threaded block fastened to the gate or is itself threaded.

The second, and very extensively used gate, employs a rod shaped actuator that terminates in a handle on one end and in a curve or cam on the other. The rod passes through a block or other bracket afixed to the gate. By turning the handle the cam of the rod is forced against the gate surface which levers against the gate and in turn presses it against the ditch sidewall to seal an opening. While this type of gate has served the agricultural community for years it does have several limitations and drawbacks.

The sliding plate type gates do not adequately seal. The cam type handle does not provide enough leverage advantage for a typical operator to be able to reliably seal the gate. Due to the force required, many farm workers do not even attempt to lock the gate cam in place leading to loss of water or crop damage.

On the other hand, when the gate is open there is a problem with the irrigation gate drifting closed. Depending upon water turbulence, flow rate, or debris, a gate using gravitational force for lowering or that travels in a vertical motion has a natural tendency to drift closed. Therefore, it is necessary to lock the gate in any open position. This requirement can be time consuming as well as unreliable. In fact for the cam type gate mechanisms, the locking force required often means that workers leave the gates unlocked, allowing them to drift closed. Gate drift thus makes repetitive patrols of irrigation ditches necessary to monitor and reset the gates. When combined with a lack of visual gate position indication, it is readily apparent that it is difficult to control irrigation rates with current state of the art designs.

A general problem with irrigation gate structures is the inability to provide visual indication of gate position. That is, one cannot tell if the gate is open, partially open, or closed, by visual inspection of the gate handle. Any change in the handle position occurs along one vertical direction and is small compared to the handle size. The ability to detect gate position visually is more than a mere "convenience". The economics of modern day agriculture have led to the development of farms with very large acreage. This translates to many miles of irrigation ditches, all of which must be controlled and monitored with a modicum of precision and reliability in order to produce the most efficient crop. Since a variety of crops may be cultivated, or raised in a predetermined rotational pattern, it is necessary to control the distribution of water across a farm in an uneven but predetermined pattern. Therefore, for the miles of irrigation ditch on a given farm, it is often necessary to set differing irrigation gates to close, partially open, or open positions. In a typical farming situation, an irrigation gate is placed at least every sixty feet along an irrigation ditch which can be on the order of 2–3 miles long. This requires the setting of 170–270 individual irrigation gates. It can be readily seen that controlling that many gates and knowing their precise position from day to day during a crop growing season, makes visual indication of the gate position very desirable.

Another problem with most irrigation ditch gate designs is the fact that they tend to seize when left unused. A typical irrigation system may be used for several months of crop production, and then left unused for many months. Generally the irrigation ditch will be drained of water, although this need not always be done, depending on the clarity of the water as well as its level during non-use. Current gate designs tend to capture or hold a small amount of water in the drain opening, exposing the metal parts to continued rusting. A sufficient amount of rust may form bridges between various metal parts that seize together, making it impossible to open when it is time to again activate the gate. In a typical farming situation, the workers trying to set such a gate may attempt to dislodge the gate by striking on it with some variety of heavy object. Sometimes this approach works, breaking loose the bridges formed by the rust and allowing the gate to move, however, two facts soon become apparent. One, there is no advantage offered by an actuator mechanism that operates by simply sliding a rod up or down. That is, it would be desirable to have some additional amount of force or leverage available to apply to the gate to try to dislodge it. Second, the gate may be damaged or destroyed in an attempt to dislodge it. In fact, there is a reasonably large business in selling replacement gates, since these gates are often damaged or simply rust out.

An additional problem related to the mechanisms used to actuate irrigation ditch gates is the non-uniformity of the actuation force or non-contiguous motions. These problems have hampered attempts to automate irrigation ditch systems for years. Present designs tend to require more force at some points of travel than at others. In addition, the force required for one gate is sometimes greatly different from the next. This stems from the fact that guide rails and associated parts for irrigation gates are custom installed in the irrigation ditch with the gates being inserted later. This leads to variations in the match between the gate dimensions and the guides.

While there have been attempts to provide a variety of rotating gate structures, they have suffered from similar drawbacks in terms of the force required to open and close, lack of visual indication for gate position, and rusting or seizing. Some of these designs require rotating and sliding motions which would make automation a complete task. In addition, current gates do not tend to be self cleaning and may even rely on special materials to form a water tight seal.

It would advance the art of water distribution and agricultural production if an irrigation ditch gate were provided that reduced problems with seizing, drifting and non-uniform actuation forces, and provided visual indication of the gate position. In addition, an irrigation ditch gate that could accommodate water debris and some abuse would prove beneficial.

SUMMARY

Therefore, it is purpose of the present invention to provide an irrigation ditch gate valve that provides visual verification and indication of the gate position.

It is another purpose of the present invention to provide an irrigation ditch gate valve that does not drift during operation and can accommodate a reasonable amount of debris in the water.

It is a further purpose of the present invention to provide a gate valve for an irrigation ditch which reduces rust out and is easily dislodged if jammed.

It is yet another purpose of the present invention to provide an irrigation ditch gate that provides reasonably uniform actuation forces over the various gate positions to assist in operation and in automation.

These and other advantages, objects, and purposes of the present invention are realized in an irrigation ditch gate valve apparatus for use in irrigation systems which comprises a port means secured to a frame with the port defining a generally circular passage for conduction of water out of an irrigation ditch. A plate means pivotally mounted on the frame and port combination pivots between a closed position where it covers the port passage and prevents the flow of water therethrough and an open position in which it uncovers the port passage to permit the flow of water therethrough. The port has a contact edge about its periphery which comes in sliding engagement with the plate means which has a substantially flat contact surface engaging the port contact edge.

A lever or handle which is somewhat flexible is pivotally attached to the plate means on one end and to a fulcrum support bar along its length. The fulcrum bar is in turn pivotally attached to the frame. The handle can pivot about the movable fulcrum point provided by the fulcrum bar to move the plate means into an open or closed position. A retention means secured to the frame exerts a retaining force on the handle lever so as to urge the plate means into close wiping engagement with the port means contact edge.

DESCRIPTION OF THE DRAWINGS

The novel features of the present invention may be better understood from the accompanying description when taken in conjunction with the accompanying drawings in which like characters refer to like parts and in which:

FIG. 8 is a cross section of a typical irrigation ditch with an irrigation ditch gate of the present invention installed;

FIG. 9 is a view in the direction of arrows 9—9 in FIG. 8, showing the gate in a partially open position; and FIG. 10 is a view similar to FIG. 9, but with the gate fully open.

DETAILED DESCRIPTION OF A PREFERRED EMBODIMENT

The present invention comprises a gate valve apparatus for controlling the flow of water out of an irrigation ditch or channel. The gate valve provides visual indication of its operating position as well as a new type of pivoting gate structure which eliminates drift, decreases rust out, and is simpler to operate and repair. The gate valve utilizes a support frame connected to a cylindrical ring which defines a water port. A specially shaped handle is pivotally mounted to the frame and a substantially circular plate opens and closes the gate port. The gate plate is positioned to slide over an inner port wall edge in order to provide an improved seal and self cleaning action.

Figure 1:
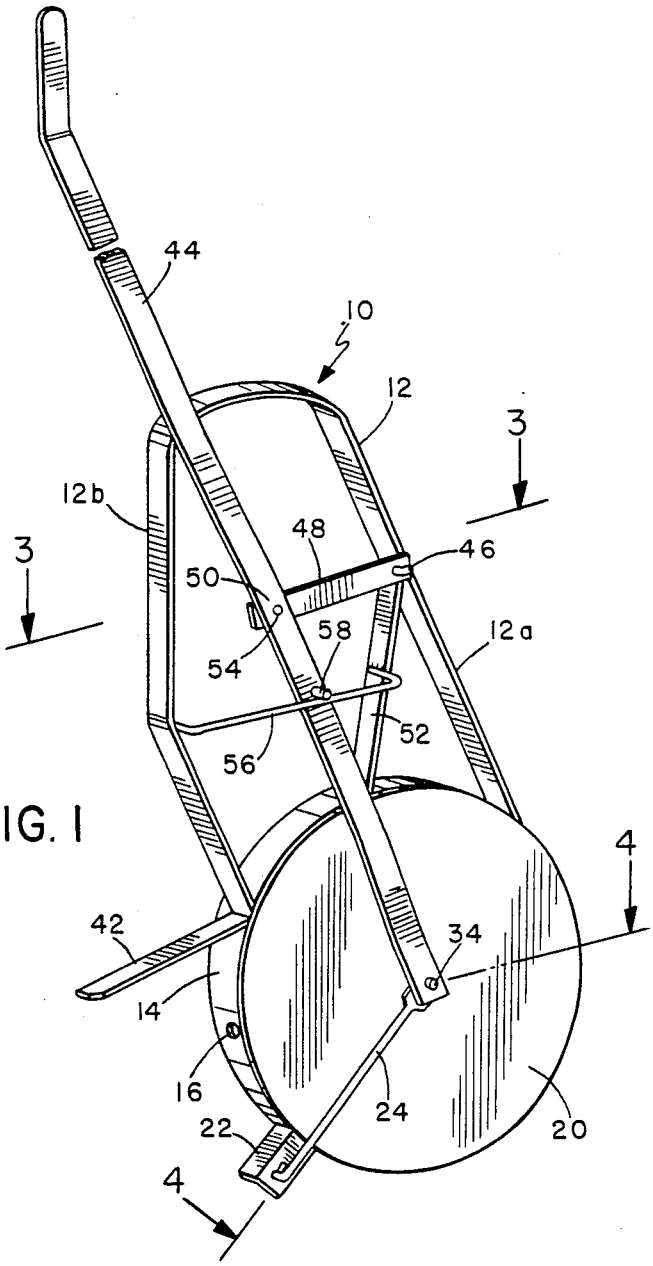
FIG. 1 is a perspective view of an irrigation ditch gate constructed according to the principles of the present invention.

One embodiment of an irrigation gate valve constructed according to the principles of the present invention is illustrated in FIG. 1. In FIG. 1, a gate valve 10 is shown in perspective, having a frame 12 extending in a generally elongated arc from a cylindrical port ring 14, a plate 20 and a handle 44. The cylindrical ring 14 forms or defines the walls of a port through which water passes when the gate valve 10 is in an open or partially opened position. The preferred embodiment is discussed below using a circular port or water passage. While it is possible to form the port ring 14 in a more elliptical or even squared shape for particular applications the circular shape is preferred as obtaining the best seal and a uniform actuation force.

The port ring 14 is made from a rust and corrosion resistant material. Exemplary materials for the construction of the port ring 14 are galvanized steel, aluminum, and stainless steel with galvanized steel being preferred.

Although it is possible to use aluminum to achieve a long life, rust-free, port ring 14, a harder material is often desired to withstand the wearing action created by the frictional forces during operation of the gate 10. In addition, softer material can be more easily deformed if it engages a piece of debris during the closing of the valve gate thereby degrading the seal. Where the irrigation gate 10 is operated infrequently or the water has little or no debris, then aluminum may be very desirable especially in the presence of permanently standing water.

A stainless steel port ring 14 provides rust and corrosion resistance while also resisting wear under repetitive irrigation gate actuation. However, stainless steel may make the irrigation gate 10 too expensive for some farming applications especially where large numbers of irrigation gates are required, even though its use may produce a longer gate life. Where expense is not a limiting factor or highly corrosive or debris filled water encountered, which can damage galvanized coatings, then stainless steel would be a preferred material.

Due to cost and longevity tradeoffs, it is contemplated that treated material such as galvanized steel provides the lower cost but high strength and rust resistance generally required for a large number of applications. Therefore, galvanized steel was employed for the preferred embodiment. The use of such a material is also helpful in case repairs are required since it is easier to work or weld and more readily available.

Returning to FIG. 1, the port ring 14 is formed to have an inside diameter commensurate with the diameter of the particular drainage or irrigation pipe through which it will feed water. For typical irrigation systems employing cement pipes exiting from centrally distributed irrigation ditches, preferred sizes generally range from 10" to 14" in 2" increments. Therefore, the diameter of port ring 14 is preferably 10", 12", or 14" with other sizes easily implemented for particular applications.

The sidewalls of the cylindrically shaped port ring 14 must be wide enough to provide both structural integrity and sufficient mounting depth. A ring width on the order of 1.5 to 2.5 inches is used with 2 inches being preferred. The material comprising the port ring 14 is typically 3/16 inches thick although this is not a required dimension.

The gate valve 10 can be secured in place using several approaches but a preferred method is to embed a portion of the port ring 14 in the material forming a side of the irrigation ditch. In order to embed the ring 14 and also prevent slippage when the valve handle is actuated, extrusion holes 16 are provided about the circumference of the ring 14. When the valve 10 is mounted in place in a material such as wet cement, slight pressure will cause cement to flow out through the holes 16 and secure the port ring 14 in place. Alternately, barbs, pins, bolts or rods could be fastened or welded to the outer surface of the port ring 14 for embedding into the ditch sidewall material. The preferred embodiment employs the extrusion holes 16 because this is a less complex arrangement and requires less welding, material, and manufacture time.

Care is taken in mounting the irrigation 10 in place to provide a sufficient projection of the port ring 14 sidewall from the sidewall of an irrigation ditch to provide a sufficient surface against which a good sliding or scraping seal is made.

The frame 12 is fastened to the ring 14 at two points on opposite ends of a chord extending across the ring 14. A portion 12*a* of the frame 12 extends upward from one side of the port ring 14 along a line that is generally tangential to the circumference of the ring 14. The frame 12 then curves in an arc and extends back down to the ring 14. The return portion 12*b* of the frame 12 extends almost straight down before turning into the ring 14. This shape is useful for supporting a lever or handle, to be discussed below, and for aligning the valve 10 within an irrigation ditch at installation. By using the straight line section 12*b* of the frame 12, the handle position will be automatically aligned for future visual observation and use.

The frame 12 comprises a low corrosion or substantially non-rusting material having dimensions similar to that of the port ring 14. This frame serves as a structural support for the handle actuation movement and for providing fulcrum points and retention forces for the handle. As illustrated in the side view of the irrigation gate 10 shown in FIG. 2, the frame 12 need not be as wide as the port ring 14 since it is not generally embedded in the irrigation ditch sidewall. However, for purposes of the present invention, the frame 12 can be made as thick or thin as desired provided structural integrity against normal operating forces and water pressure is maintained.

A gate 20 is used in the valve 10 to cover and uncover the port created by the port ring 14. The gate 20 comprises a generally circular disc which has a diameter larger than the diameter of the ring 14. In this manner when the plate 20 is approximately centered over the ring 14 it will seal the port opening and prevent the flow of water therethrough. The gate plate 20 comprises a material that resists rust and is somewhat flexible such as 20–18 gauge galvanized sheet metal. Other material such as stainless steel or aluminum can be employed, subject to the limitations discussed earlier and dimensional adjustments for strength.

The gate plate 20 is mounted in place to pivot across the port ring 14 using one of at least two techniques. The first, more preferred method is illustrated in greater detail FIG. 4 and FIG. 5.

Figure 4:
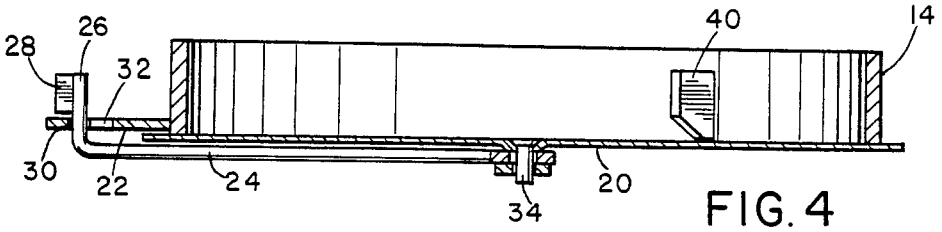
FIG. 4 is an enlarged sectional view taken along line 4—4 of FIG. 1.

In FIG. 4 an angle bracket 22 is fastened to the outside of the port ring 14 such as by welding. An exemplary bracket 22 would be made from $1\frac{1}{2}\times1\frac{1}{2}\times3/16$ galvanized steel angle iron.

A support bar 24, which can be rectangular or round, is fastened on one end at the center of the plate 20 and extends beyond the outer circumference of the plate 20 on the other end. The outer end of the bar 24 has a rod-like extension 26 which extends toward the angle bracket 22. At the same time, a small rectangular piece or key 28 is welded or otherwise fastened to this rod shape for creating a "keyed" cross section. This is further illustrated in FIG. 5 where the "keyed" extension 26 passes through a matching passage 30 in the bracket 26. By shaping the passage 30 so that it has a square keyway or slot 32 at a predetermined position in its circumference, the extension 26 can only be inserted or removed from the bracket 22 when the plate 20 is in the fully open position of the gate 10. Otherwise the extension 26, support bar 24, and plate 20 are pivotally locked in place on the port ring 14 in any other position.

Figure 5:
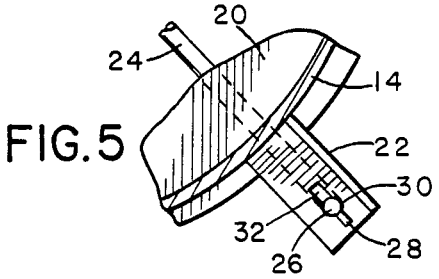
FIG. 5 is an enlarged rear view of the gate hinge structure.

The extension 26 should be positioned adjacent to and in contact with one side of the angle bracket 22 for maximum leverage and support in operation. FIGS. 4 and 5 show this separation exaggerated for clarity of illustration.

To fasten the support bar 24 in place at the center a bolt 34 can be employed. Such a bolt would be inserted through the plate 20 and be countersunk so that the flat surface of the plate 20 is uninterrupted for sliding across the port ring 14. Although the preferred method is to inset the bolt head in the plate 20 and extend the bolt through the plate, it is also possible to simply weld a bolt to the outer surface of the plate 20.

Figure 6:
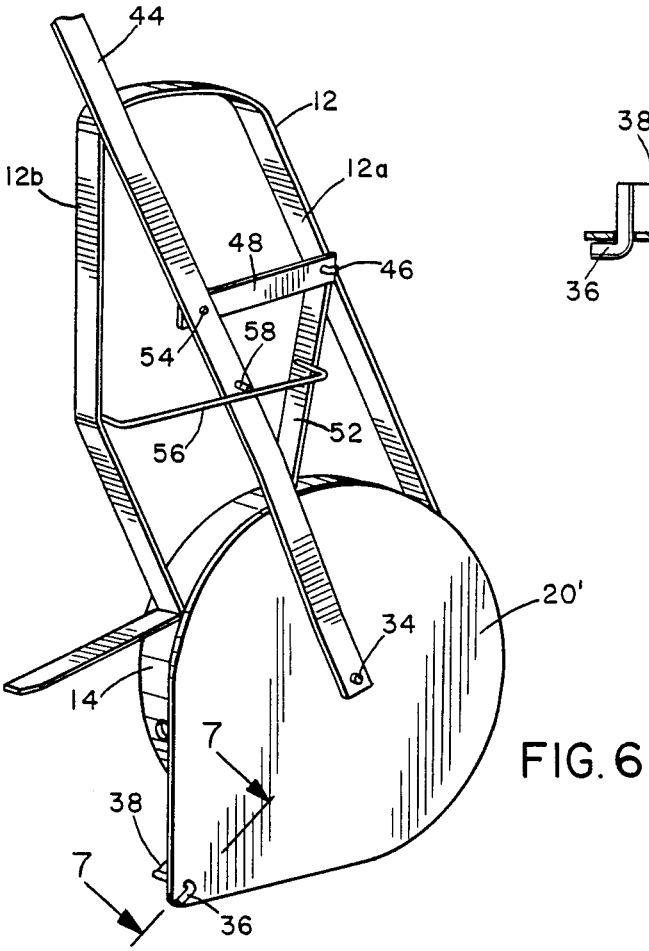
FIG. 6 is a perspective view of an irrigation ditch gate according to the present invention showing an alternative hinge arrangement.
Figure 7:
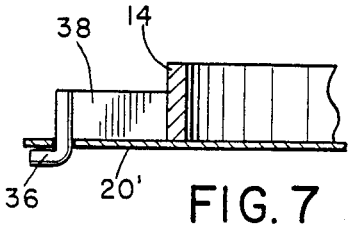
FIG. 7 is an enlarged sectional view taken on line 7—7 of FIG. 6.

A second method of fastening a gate plate in position is illustrated in FIGS. 6 and 7. In FIG. 6 a plate 20′ pivots about a projection 36 along one edge of the port ring 14. The projection 24 is in the form of a small round or rod-like piece welded to the outer wall of the port ring 14. As shown in greater detail in FIG. 7, it is desirable to provide an extension piece 38 on which the projection 36 is mounted. The extension 38 serves to position the projection 36 away from the edge of the port ring 14 to assure that the plate 20′ will rest against the port ring 14 and not be held off by the projection 36 which would degrade the water seal of the irrigation gate 10.

The rod-like projection 36 extends up from the extension 38 and bends over and outward from the port ring 14 at an angle greater than about 45 degrees. The actual bend angle is determined by the degree of "capture" desired. A hole bored in the plate 20 engages the rod 36 and holds the plate 20′ against the port ring 14. The preferred embodiment utilizes the rod projection 36 as opposed to a bolt type fastener so that the plate can be disassembled and repaired or replaced if need be without requiring tools. The assembly can be simply pried and rotated apart. This is very advantageous in an agricultural setting where it is impossible to carry tools around and the situation when they are needed is unpredictable.

In operation, pressure is applied to the plate 20 or 20′ to assure a proper seal against the port ring 14 as they are pivoted across the ring. Also in the presence of water some additional pressure is applied by the force of the water. This pressure tends to deform the plates into the port opening. Therefore, a deflection piece 40 can be fastened to an inside edge of the port ring 14 to "catch" an edge of the plate 20 or 20′ and lift it back over the sidewall of the port ring 14. The preferred embodiment employing the support bar 24 and a circular plate 20 generally avoids this problem while the projection 36 and plate 20′ combination are prone to this type of deflection.

At the same time, there is an advantage in using a material such as sheet metal for the plate 20 and allowing it to be somewhat flexible. If pieces of debris are encountered in closing the gate 10, the plate 20 can deform outward around the debris and continue to close. This allows at least a partial seal of the port whereas previous gate designs would be blocked open and allow a greater flow of water through the port.

Extending radially outward from the side of the port ring 14 is a guide bar 42 for supporting the plate 20 in the open position. This prevents the plate 20 from binding against the side of the port ring 14 during operation and also from scraping against the sidewalls of an irrigation ditch.

Extending upward from the plates 20 or 20′ is a handle 44. The bolt 34 on the gate plate 20 (and similarly on plate 20′) extends up through the end of the handle 44. This secures the end of handle 44 and the plate 20 together so that the handle 44 can rotate the plate 20 across the port ring 14.

The handle 44 extends from the plate 20 to well past the top of the frame 12. The handle 44 comprises a single strong piece of material. A preferred material is plow steel which is structurally very strong, but easy to remold should it become bent. The steel is protected using a galvanized or similar coating. Again, other materials can be employed subject to cost, availability, and strength tradeoffs.

Along the side 12*a* of the frame 12 is positioned a pivot or projection 46 which is used for mounting a fulcrum arm or lever 48. The fulcrum arm 48 is attached to the frame 12 on one end and to the handle 44 on the other. The end of the fulcrum arm 48 attached to the frame 12 has a hole which slips over the round or rod-like pivot 46 which is itself secured to the frame 12 such as by welding. The projection 46 is bent to help prevent the lever arm 48 from slipping off of the frame 12. This projection secures the fulcrum lever 48 in place in the same manner as seen in the plate 20′ mounting above. This makes disassembly without special tools possible for maintenance. In the alternative a bolt and nut combination could be used.

The other end the fulcrum arm or lever 48 attaches to the handle 44 using a loose fitting rivet or other pivoting fastening means. This allows the handle to rotate freely and yet lever against the fulcrum arm 48 to create the operating leverage for the gate plate 20 of the irrigation gate 10. This double pivot arrangement provides the handle 44 with several features which allow the present invention to advance the art of irrigation values. First, the double pivot allows a greater degree of mechanical power to be delivered to moving the gate based on the ratios of the lever arms. Second the pivots allow the force to maintain a fairly constant value over the entire motion of the gate 20.

The fulcrum arm 48 is fastened to the handle 44 at a position determined by the amount of work force advantage desired for the operation of the irrigation gate 10. In the preferred embodiment the fulcrum arm 48 attaches to the handle 44 at a distance from the center of the plate 20 that is about $\frac{1}{3}$ the total length of the handle 44. This provides an approximate 2 to 1 ratio in the length of the lever arms about the fulcrum point 50 created by the end of the fulcrum arm 48. The fulcrum arm 48 is fastened on the frame 12 at a position above the port ring 14 that is about the same distance from the center of the ring 14.

The fulcrum point 50 can be positioned along the length of the handle 44 as appropriate to achieve the desired ratio of the leverage forces dependent upon the force desired for closure and self cleaning. However, the ratio of 2:1 described above is preferred as achieving the best force with the best leverage effort.

The length of the fulcrum arm 48 is determined by the overall size of the frame 12 and the motion of the handle 44. The fulcrum arm 48 is designed to maintain the position of the fulcrum point 50 approximately centered over the outer edge of the port ring 14 during operation.

In order to provide additional support for the forces exerted on the fulcrum arm 48 a support arm 52 is provided. The support arm 52 extends from the area of the pivot or projection 46 to the port ring 14. As shown in FIG. 1, this provides vertical support for the projection 46 and prevents the frame portion 12*a* from flexing downward toward the port ring 14, which would decrease the leverage force.

Figure 2:
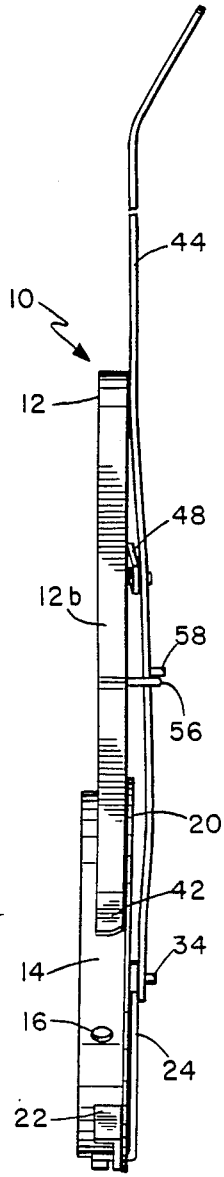
FIG. 2 is a side elevation view of the irrigation gate of FIG. 1.

As shown in the side view of FIG. 2, the handle 44 is bent in two locations, one below the rivet 54 and the other above the frame 12. These bends create a portion of the handle 44 which projects farther away from the frame 12. This portion is used in combination with a retention member 56 to exert a sealing force on the gate plate 18.

Positioned across the frame 12 is a retention slide 56. This slide can be a bar or rod of metal welded or otherwise secured to the frame 12. The retention slide 56 serves to hold the handle 44 against the frame 12 to keep it in place. At the same time, by placing an angle in the handle 44, a closing force is exerted against the handle 44. The bend of the handle presses against the retention bar to maintain a good seal and wiping motion on closing the gate 10 which keeps the plate 20 and the port ring 14 sealing edge clean.

Figure 3:
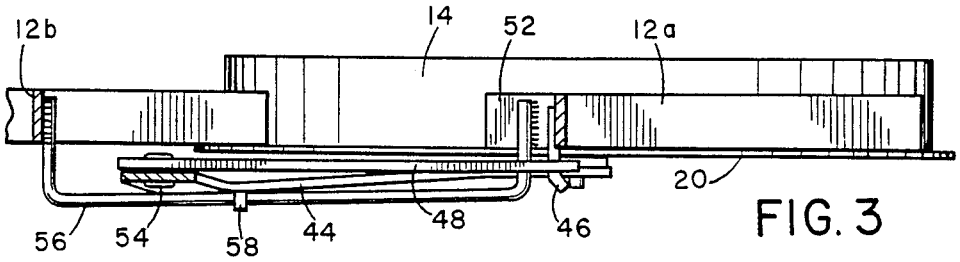
FIG. 3 is an enlarged sectional view taken along line 3—3 of FIG. 1.

While other fastening means can be employed in the preferred embodiment a welded piece of iron was employed for the retention slide 56. The slide 56 is positioned adjacent to the frame 12 so that it is closer to the frame on one side than the other. This is illustrated in FIG. 3 which is a side view of the frame 12 of FIG. 1 taken along the line 3—3. It can be seen in FIG. 3 that on the left the rod is positioned farther from the plane of the frame 12 than on the right. The retention slide 56, therefore, presses against the handle 44 more on the right than on the left. This creates an increasing force against the handle 44 as the handle closes the gate 10 and causes a tight sealing scissors action of the gate plate 20 or plate 20' against the port ring 14.

A guide pin 58 is positioned on the handle 44 to slide against the retention slide 56 and guide the handle 44 under the slide.

FIGS. 8, 9 and 10 illustrate an irrigation gate of the present invention in position in an irrigation channel or ditch 60. The irrigation ditch 60 illustrated in FIG. 8 is constructed as typically found in the southwestern United States. This type of structure is used for illustration purposes only and the irrigation gate of the present invention is useful with other structures as well.

In the irrigation ditch of FIG. 8 earthen material 62 such as dirt or sand is mounded to form a berm 64 for structural support. This is done both for the ease and low cost of construction as well as the fact that many of the water sources are coming in from higher elevations and there is no need to dig down into the ground for proper ditch elevation.

Irrigation pipes 66 are installed in the berm 64 wherever it is desired to transfer irrigation water out of the irrigation ditch 60. In the typical application, irrigation gates are installed every 20 to 80 feet along an irrigation channel or ditch. The pipes 66 are installed when the berm 64 is formed or later on using digging equipment.

A concrete lined channel is constructed within the earthen berm 64 having sidewalls 68 whose thickness is on the order of around 1.5–2 inches. The depth is not critical and depends on the local soil conditions and the overall size of the channel. A typical channel is perhaps 30 to 50 inches deep depending upon the amount of water to be transferred and the specific application and location as would be readily understood by those skilled in the art of irrigation systems.

If the cement pipe is in place and the concrete side walls are poured or if the walls are poured by leaving a "punch-out" for the pipe, fresh cement 70 will be used to seal the joint between the pipe and the sidewalls of the irrigation channel or ditch. At the time this cement is placed, the irrigation gate valve 10 is positioned within the ditch 60 and the port ring 14 pressed into the wet cement. Other materials can be used but this is the typical construction technique for irrigation ditches.

The cement extrudes itself through the previously described extrusion holes 16 which secures the ring 14 and the gate 10 in place. While it is not necessary, the frame 12 can also be pressed into the cement forming the sidewall 68 of the ditch 60 if the wall is still malleable. This would provide maximum support and securing for the gate 10.

Care is taken at this time to position the frame member 12 of the valve 10 so that the handle motion will be visible and provide visual indication of the valve position. To this end the frame 12 is placed so that when the valve is approximately half open or closed the handle 44 will extend vertically straight up from the bottom of the ditch 60. Therefore, the handle end 72 extends over the sidewall 68 and appears approximately perpendicular to the top edge of the irrigation ditch 60.

The irrigation gate of the present invention is also easily installed in existing irrigation systems using the same basic technique. This allows the replacement of damaged or broken gates as well as those that do not provide adequate sealing.

After installation the handle 44 is now moved to provide the desired water flow. Since there is water pressure on the plate 20 and the retention force on the handle 44, wherever the handle is positioned, it stays and does not drift. This advances the state of the art by allowing predictable and continuous water flow without monitoring and without extra locking or securing motions and means.

The gate plate 20 position will be readily apparent from visual inspection at a distance as illustrated in FIG. 9 and FIG. 10 wherein the gate 10 is illustrated in the partially and fully open positions respectively. The sliding motion of the gate will press the plate against the port ring and tend to scrape off any debris or deposits further improving the control over sealing.

In FIG. 9 the first, phantom indication line, position 80 of the handle represents the fully closed position for the gate 10. The handle 44 position shown at 82 is half open while the handle position in FIG. 10 at 84 is fully open. The percent of closure for the irrigation gate 10 is roughly proportional to the angular position between the two extreme positions. In this manner the position of the gate can be determined quickly at a glance without looking inside the water, which is generally impossible. Also the handle can be brightly colored to provide easy visual inspection from a fairly large distance.

The irrigation gate 10 is illustrated as being closed to the left and open to the right, however, it will be apparent to those skilled in the art that the frame 12 can be faced the opposite direction along with the fulcrum arm 48 and handle 44 so that the opposite motion is used. This may be useful for some applications, especially where automation of gates on opposite sides of a ditch are desired and require movement in the same direction along the irrigation ditch length.

The generally uniform force needed over the travel of the handle 44, as well as the simple motion employed in the handle movement allows the automation of the irrigation gate 10 in a manner previously unavailable to designers.

The method of forming and mounting the irrigation gate 10 in the irrigation ditch 60 as a unitary structure also improves the seal provided by the gate 10. The gate plate 20, and port ring 14 are automatically positioned so that the sidewalls of the ditch 60 do not interfere with operation and no external guides or supports are required.

The gate in the open position tends to drain any water from the port ring 14. That is once the ditch 60 is emptied of water for the season or for a period of non-use, the port ring 14 tends to drain water off of itself. This improves the lifetime of the ring by decreasing the formation of rust.

Should rust form anyway, the leverage provided by the handle 44 allows rust bridges to be broken and the gate 10 opened without extra tools. The handle 44 can be easily extended using a piece of tubing which can be in the form of a length of pipe carried around to increase the leverage arm force. For extremely corrosive water conditions or where water is left standing all year round a longer handle length is used or an added section using bolts that can be slidably extended can be employed.

What has been described then is an improved irrigation ditch valve which provides the advantages of visual indication of position, no gate drift, decreased rusting or rust out, and ease of service and operation even in water having a significant amount of debris.

It is understood that further variations in construction such as alternate materials may be employed. If mass production techniques are used, and the application warrants, other materials such as molded or extruded plastics may be employed to form a unitary port and frame structure.

The foregoing description of a preferred embodiment has been presented for purposes of illustration and description. It is not intended to be exhaustive nor to limit the invention to the precise form disclosed, and many modifications and variations are possible in light of the above teaching. The embodiments were chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What I claim is:

1. An irrigation ditch gate, comprising:

a frame;

port means for defining a passage for conduction of water, configured for mounting in a wall of an irrigation ditch and attached to said frame;

plate means pivotally mounted on said port means, for being pivoted transverse to said passage, between a closed position adjacent said port means to cover said passage and prevent the flow of water therethrough, and an open position to substantially uncover said passage to permit the flow of water therethrough;

a first lever means for moving said plate means between the closed and open positions, said first lever means being pivotally attached on a first end to said plate means;

second lever means for providing a moving fulcrum for said first lever means, said second lever means having a first end pivotally attached to said frame and a second end pivotally attached to said first lever means; and retention means for exerting a retaining force on said first lever means substantially perpendicular to the direction of travel of said first lever means so as to urge said plate means into close wiping engagement with said port means.

2. The irrigation ditch gate of claim 1 wherein said port means comprises a cylindrical ring of metal having a cylindrical wall with a width of at least 1.5 inches.

3. The irrigation ditch gate of claim 2 wherein said metal is chosen from the group comprising aluminum, stainless steel, or galvanized steel.

4. The irrigation ditch of claim 2 wherein said cylindrical wall has a plurality of passages distributed thereon for the extension therethrough of a portion of a material comprising a sidewall of an irrigation ditch immediately adjacent to said port means when installed in said irrigation ditch.

5. The irrigation ditch gate of claim 1 wherein said lever means comprises a metal bar comprising galvanized plow steel.

6. The irrigation ditch gate of claim 1 wherein said retention means comprises a rod positioned adjacent to said frame for engaging said first levermore means, extending from a first to a second side of said frame and being further positioned closer to said frame on said first side than on said second side.

7. The irrigation ditch gate of claim 1 wherein said gate means comprises:

a generally circular plate having a fastening means in a central location thereof;

a support bar having first and second ends, secured to said fastening means on said first end with said second end extending radially outward from said fastening means and extending beyond said passage; and support means for pivotally supporting said second end of said support bar on said port means.

8. The irrigation ditch gate of claim 7 wherein said support bar has a central axis and said second end is configured in the shape of a rod which projects at approximately 90 degrees to said central axis with a key projection formed thereon, and said support means has a passage for accepting said second end with a matching key way therein.

9. The irrigation ditch gate of claim 8, wherein said plate comprises a plate of metal chosen from the group of galvanized sheet metal, stainless steel, or aluminum.

10. The irrigation ditch gate of claim 1 wherein said gate means comprises:

a substantially circular plate having an elongated projection along one portion of its circumference; and a pivot support means for pivotally supporting said elongated projection of said gate means, said pivot support means being attached to said port means outside of said passage.

11. The irrigation ditch gate of claim 10 wherein said pivot support means comprises a rod segment attached to said port means and extending through an opening in said elongated extension of said plate.

12. The irrigation ditch gate of claim 10, wherein said plate comprises a plate of metal chosen from the group of galvanized sheet metal, stainless steel, or aluminum.

13. The irrigation ditch gate of claim 1 further comprising slide support means for providing support for and stiffness to said plate means during pivoting between open and closed positions, being secured to said port means and positioned outside of said passage and under a path of travel of said plate means during pivoting.

14. The irrigation ditch gate of claim 1 wherein said frame comprises a first and second side each having first and second ends with said first ends joined together by a generally arcuate end member and their second ends fastened to said port means and having a portion of said second side extending substantially parallel to said lever means when said gate means in is a half open position.

15. The irrigation ditch gate of claim 13 wherein said retention member comprises a metallic rod having first and second ends attached to said first and second sides and is positioned to press against said lever with greater force on said first end than on said second end.

16. The irrigation ditch gate of claim 1 further comprising brace means secured on a first end to said port means and on a second end to said frame adjacent to where said second lever means first end is pivotally attached to said frame.

17. The irrigation ditch gate of claim 1 further comprising deflection means for deflecting said gate means upon closing said passage, said deflection means positioned within said passage adjacent to where said plate means contacts said port means.

* * * * *

UNITED STATES PATENT AND TRADEMARK OFFICE

CERTIFICATE OF CORRECTION

PATENT NO. : 4,685,828

DATED : August 11, 1987

INVENTOR(S) : Lee M. Whittle

It is certified that error appears in the above-identified patent and that said Letters Patent is hereby corrected as shown below:

Column 12, claim 6, line 25, delete "levermore" and insert therefor --lever--

Signed and Sealed this

Eighth Day of March, 1988

*Attest:*

*Attesting Officer*

DONALD J. QUIGG

*Commissioner of Patents and Trademarks*